United States Patent [19]

Ernst et al.

[11] Patent Number: 4,614,225

[45] Date of Patent: Sep. 30, 1986

[54] MAGNETIC ROTOR FOR THE CONTINUOUS CASTING OF HOLLOW BODIES

[75] Inventors: Roland Ernst, Gieres; Marcel Garnier, Saint Martin d'Uriage; Michel Giroutru, Saint-Egreve; René Moreau, Voiron, all of France

[73] Assignee: Vallourec, Paris, France

[21] Appl. No.: 558,488

[22] Filed: Dec. 6, 1983

[30] Foreign Application Priority Data

Dec. 10, 1982 [FR] France ..... 82 21271

[51] Int. Cl.[4] ..... B22D 11/10; B22D 27/02

[52] U.S. Cl. ..... 164/504; 164/421; 164/465; 164/468

[58] Field of Search ..... 164/504, 468, 464, 465, 164/421, 422; 335/303-306

[56] References Cited

U.S. PATENT DOCUMENTS 3,349,354 10/1967 Miyata ..... 335/306 X 3,454,913 7/1969 Israelson ..... 335/306

*Primary Examiner*—Nicholas P. Godici

*Assistant Examiner*—J. Reed Batten, Jr.

*Attorney, Agent, or Firm*—McDougall, Hersh & Scott

[57] ABSTRACT

The process and the device according to the invention relate to the continuous casting of hollow bodies made of metals such as aluminum, copper, steels of all types or other metals or alloys. The process involves introducing the liquid metal into an annular space between an external mold and an internal mandrel, the liquid metal being subjected in the vicinity of the mandrel to the action of a moving magnetic field which drives it upward. This field is created by a magnetic rotor housed in the mandrel comprising a rotating part around which is arranged at least one spiral made of magnetized magnetic material made integral with the rotor by at least one collar. The process is applied, in particular, to the production of blanks intended for the manufacture of seamless tubes.

15 Claims, 6 Drawing Figures

MAGNETIC ROTOR FOR THE CONTINUOUS CASTING OF HOLLOW BODIES

BACKGROUND OF THE INVENTION

The device and the process forming the subject of the invention relate to the manufacture of hollow bodies by the continuous casting of metals or metal alloys. They relate more particularly to the manufacture by continuous casting of hollow metallic bodies of circular cross-section used as blanks for the manufacture of seamless tubes. It is known that, for such manufacture, the hollow bodies used as blanks must exhibit a high quality of internal and external skin.

French Pat. No. 2.519.567 describes a process for the manufacture of hollow metallic bodies by vertical continuous casting in which a liquid metal is introduced continuously into an annular space between an external metal mold cooled by circulation of fluid and an internal mandrel also cooled by circulation of fluid. The metal gradually solidifies in contact with the walls of the mold and of the mandrel, forming a hollow body which is extracted beneath the mold. In an annular zone adjacent to the external surface of the mandrel, the liquid metal is subjected to the action of a moving magnetic field which creates within this metal forces having a vertical component directed from bottom to top which entrain this metal towards the free surface of the metal bath. This patent describes several methods of producing the moving magnetic field according to the invention. In particular, it describes a method of producing this moving magnetic field which involves the use of permanent magnets arranged over a rotating rotor contained within the internal mandrel, this rotor being caused to rotate about its axis.

The following descriptions, figures and examples will help understanding of the characteristics of the process for the continuous casting of hollow bodies and of the method of producing the moving magnetic field described in French Pat. No. 2.519.567 as well as the characteristics of the magnetic rotor for the continuous casting of hollow bodies forming the subject of the present invention.

BRIEF DESCRIPTION OF THE DRAWINGS

FIG. 1 shows a device for the rotational continuous casting of hollow bodies made of steel according to French Pat. No. 2.519.567. This device comprises an external mold 1, or ingot mold, rotating about a cooled vertical shaft of general tubular shape and of circular cross-section, an internal mandrel 2, a system for supplying liquid metal schematised by the arrow 3 and a vertical helicoidal system for the extraction of the cast products. As these last two systems are the same as those used for the rotational continuous casting of solid round rods, they are known to the skilled man and are not therefore shown. The ingot mould 1 or external mould is shown simply by its wall 4 limited at 5 and 6. This wall generally has a slight conicity with a reduction of cross-section in its lower portion which permits contact with the solidifying metal. Its cooling system and its rotational drive means are known to the skilled man and are not therefore shown. The free surface of the metal is at 7 and the partially solidified hollow body of circular cross-section is at 8.

The hollow internal mandrel 2 is constituted by two portions: the bottom portion situated at the level of the mold 1 and immersed in the solidifying metal constituting the active portion of the mandrel and the top portion situated above the mold 1 and bearing the control and support mechanisms for the bottom portion.

In its bottom portion, the mandrel comprises a sleeve 9 of generally tubular shaped, of circular cross-section and of a height which is slightly greater than the height of the ingot mold 1. The sleeve 9 advantageously has conicity with reduction of the cross-section towards the bottom to allow removal of the solidifying metal. The sleeve 9 is generally produced from a non-magnetic material having good thermal conductivity, for example from copper or a copper alloy.

Figure 2:
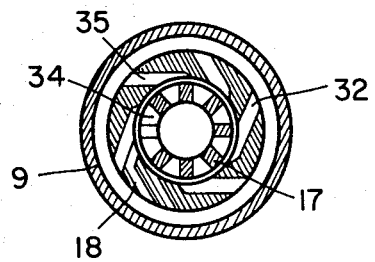
PRIOR ART FIG. 2
FIG. 2 is a view of the turbine driving the magnetic rotor along the section C–C' in FIG. 1.

The mandrel 2 is held in position in the mold by support means shown in FIG. 2 in such a way that the sleeve 9 is perfectly co-axial with the mold 1.

The sleeve 9 is assembled, for example, by a sleeve coupling at 10 with a static gasket 11 with a rotating support tube 12 constituting the upper portion of the mandrel and of which the upper end penetrates into the mandrel head 13. A double lip joint 14 permits free rotation of the mandrel relative to the head 13 while ensuring a seal relative to the fluid under pressure circulating inside.

Figure 3:
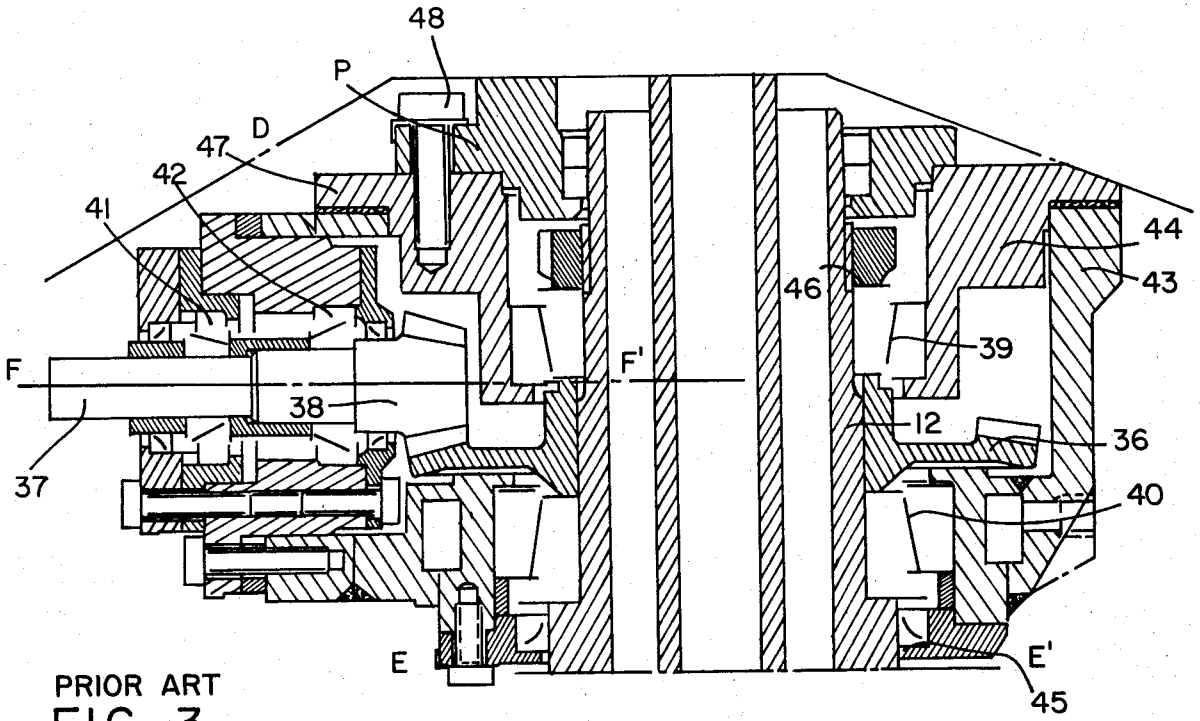
PRIOR ART FIG. 3
FIG. 3 is a view of the system for rotating the mandrel in FIG. 1, which travels between the planes of section D–D' and E–E' in FIG. 1.

The rotation of the sleeve 9 is controlled by a motor system shown in FIG. 3 which permits mechanisation of rotation of the mandrel 2 and holds it in a general vertical and centred position relative to the mold 1, the axis of the mandrel being combined with that of the mold 1. This mechanical driving device is described below.

The head 13 fixed on the motor device in FIG. 3 by a fixing tab (P) bears supply pipes 15 and delivery pipes 16 for the coolant.

Inside the hollow mandrel 2, a central tube 17 of circular cross-section which is co-axial with the sleeve 9 bears in its bottom portion a magnetic rotor 18 which surrounds it and which is mounted freely rotatably relative to the tube 17.

The tube 17 is closed in a sealed manner at its bottom portion 19. It is made integral with the support tube 12 via radial plates 20–21 which do not form an obstacle to the axial flow between 12 and 17 of the coolant.

The sleeve 9 and the tube 17 are made integral in a sealed manner at the bottom portion via the annular bottom part 22 with static sealing O rings 23 and 24. At its upper end, the tube 17 is centred via an annular part 25 relative to which it rotates freely owing to a lip joint 26. The part 25 is in turn mounted in a sealed manner by means of a static O ring 27 inside the head of the mandrel 13.

A nut 28 screwed at 29 on the tube 17 ensures that the bottom part 22 is locked.

Thus the sleeve 9, the support 12, the tube 17 and the bottom part 22 are perfectly integral and can turn at the same speed of rotation.

The magnetic rotor 18 is constituted by a hollow cylinder which rotates freely on the tube 17 and bears magnetic masses on its external surface. Its particular structure is described below. The length of the rotor is selected in such a way that its upper portion clearly exceeds the level corresponding to the free surface of the liquid metal in the vicinity of the sleeve 9. The device should be constructed in such a way that the gap between rotor 18 and sleeve 9 is as small as possible in view of the need to maintain an adequate cross-section for the passage of the coolant.

The speed of the rotor 18 is not linked to the speed of the tube 17 and the said rotor turns on rings of a suitable material, for example a material based on resin plus fibre 31 and 32 positioned on the tube 17. The rotor 18 of which the rotational speed has to be high (1,000 to 3,000 rpm) is rotated by the coolant by means of a turbine 33 maintained in the bottom portion of the rotor and therefore integral therewith.

FIG. 2 shows the profile of the turbine in section. The coolant which is at a suitable pressure inside the tube 17 issues from the tube via radial holes such as 34 distributed in a suitable number on the periphery of the tube 17. A number of openings such as 35 of suitable profile are distributed over the periphery of the rotor 18 and are orientated so as to initiate rotation of the rotor by reaction.

The profile of the openings 35 as well as the adjustment of the pressure of the coolant used permit the speed of rotation of the magnetic rotor 18 to be controlled within the desired speed range. Thus, according to this device, the coolant, which is generally water and enters at 15, descends inside the tube 17 and rises again in the gap 30 to leave at 16, permits cooling of the sleeve 9 for eliminating the calories from the metal bath and allows cooling of the rotor and of the magnetic bodies.

Suitable design of the parts permits a speed of the order of 3,000 rpm and a temperature of the magnetic bodies lower than 100° C. to be attained at a water pressure of 2 to 3 kg/cm$^2$, the speeds of circulation adopted allowing the presence of air in the cooling circuit to be avoided.

A rotation speed of the rotor which permits a sufficiently high speed of rising travel of the liquid metal to be obtained is preferably selected. The ratio between the speed of rising travel of the liquid metal and the speed of rotation of the rotor depends on this speed of rotation. Beyond a critical speed of rotation, the speed of rising travel of the liquid metal no longer increases and, on the contrary, starts to diminish rapidly. This critical speed of rotation depends, in particular, on the nature of the material constituting the wall of the sleeve 9 and the thickness thereof.

In the case of a copper sleeve, this critical speed of rotation of the rotor "$N_c$" expressed in rpm is determined approximately by the formula:

$$N_c = 300{,}000/e^2$$

"e" being the thickness of the wall of the sleeve 9 expressed in millimetres.

The rotation of the mandrel 2 is permitted by the mechanism in FIG. 3. This assembly travels between the planes D–D′ and E–E′ in FIG. 1. This mechanism is essentially constituted by a toothed crown 36 banded on the part 12 moved by a driving shaft 37 at the end of which there is located a conical pinion 38.

The crown is supported in its rotation by two conical roller cases 39 and 40 which permit the mandrel 2 to be held in a fixed and centred vertical position. The shaft 37 also rotates in a case with two conical rollers 41 and 42, a sealed and cooled housing 43–44 closing the assembly. Some gaskets 45 and 46 provide a seal during rotation of the mandrel.

The head of the mandrel 13 is fixed on the casing bearing the driving shaft by tabs (P) and 47 and the bolts 48.

The mandrel 2 is positioned on the mould 1 by a system, which is not shown, of tabs which are fixed on the one hand on the work floor which can be located at the level of the mold 1 and on the other hand on the housing 43–44 or on the mandrel head 13. The mandrel is thus maintained in a well defined vertical position.

Figure 4:
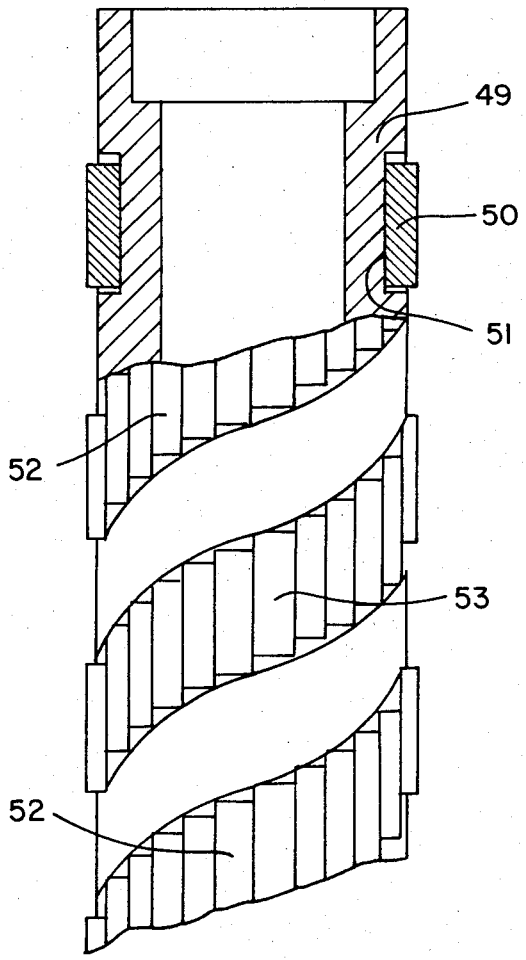
PRIOR ART FIG. 4
FIG. 4 is a front view in a partial axial section of the magnetic rotor in FIG. 1.

The structure of the magnetic rotor 18 creating the moving field is shown in an elevation in FIG. 4, the top of the Figure being in section.

Figure 1:
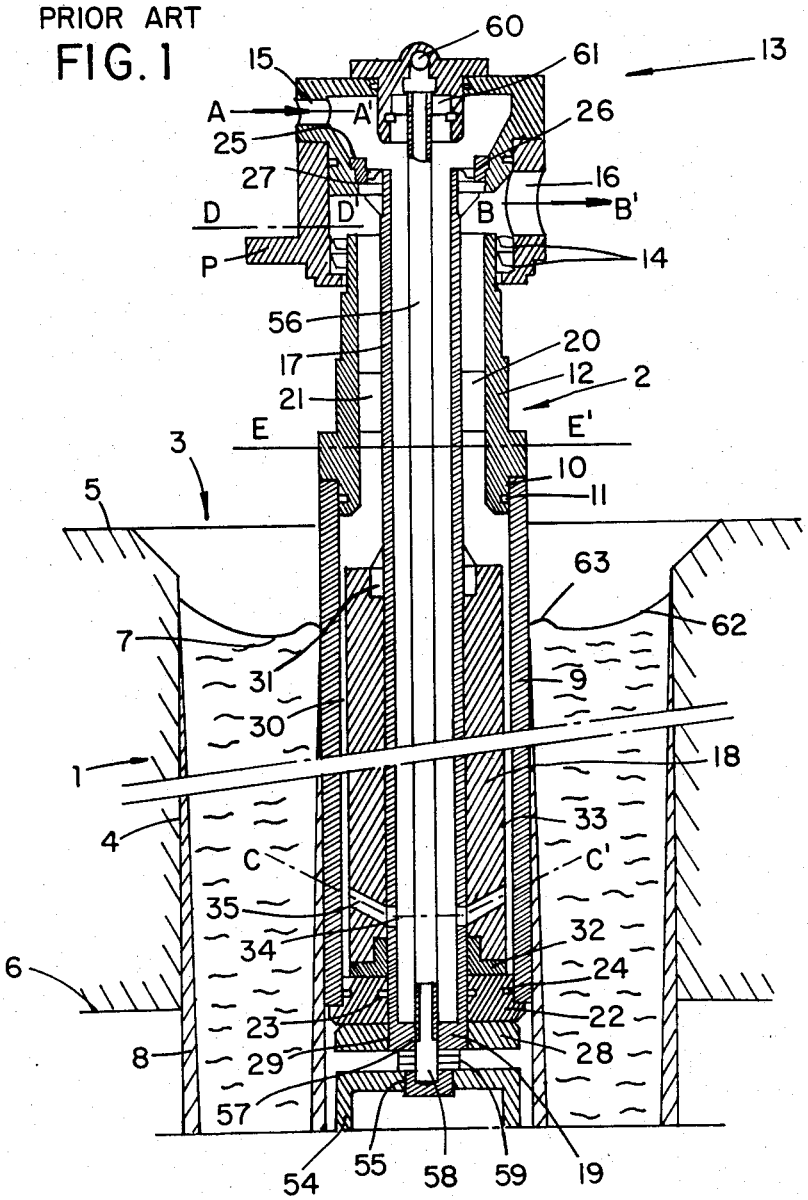
PRIOR ART FIG. 1
FIG. 1 is an overall view in an axial vertical section of the device for the continuous casting of hollow bodies according to French Pat. No. 2.519.567.

This rotor is constituted by a hollow cylinder 49 made of structural steel, of which the ends are profiled to permit mounting of the rings 31–32 in FIG. 1 allowing the said rotor to be centred in rotation with a minimum of friction.

The magnetic bodies are constituted by permanent magnets such as 50 positioned in housings such as 51 produced side by side in a spiral on the surface of the cylinder. These magnets are fixed in their housing, for example by adhesion. It is advantageous to use magnets of parallelepided shaped with a rectangular face, of which the large sides are orientated parallel to the generatrices, the north south axis perpendicular to the large faces corresponding to the smallest distance between faces of the parallelepided and being radial, that is to say perpendicular to the axis of the rotor.

In the embodiment shown in FIG. 4, there are two co-axial spirals 52 and 53 located round the rotor in the manner of a double fillet thread having a right-hand thread, each spiral being magnetically orientated in a uniform manner, that is to say so that the poles closest to the axis of the rotor of all magnets of the same spiral are of like poles. On the other hand, the magnetic orientation of the two spirals is opposed. Thus, in the case shown in FIG. 4, the poles of the spiral 52 closest to the axis of the rotor are south whereas those of the spiral 53 closest to the axis of the rotor are north.

Any sufficiently stable permanent magnet can be used.

The winding direction of the spiral or spirals on the rotor should be the same as the direction of rotation of the rotor about its axis when viewed from above. Thus if the rotor turns in a clockwise direction when viewed from above, the spiral or spirals must have a right-hand pitch. This rotor structure creates by rotation a sliding field of which the direction of travel is perpendicular at each point to the fillets of the spiral and contained in the plane tangential to the surface of the cylinder. The direction of travel of this sliding field therefore exhibits, on the one hand, a vertical component which drives the liquid metal from bottom to top and a horizontal component of the magnetic field which tends to cause the liquid metal to rotate on the other hand.

The pitch of the spiral or spirals, that is to say the distance between two single turns of the same spiral along a generatrix, is selected so that the horizontal component of the magnetic field remains weak but does not come too close to the magnetic bodies on the same generatrix of the rotor so that there are field lines penetrating deeply into the liquid metal. The distance on the same generatrix between the closest ends of a north magnet and a south magnet is preferably not less than the great length of the base parallelepiped.

The device can be improved, as shown in FIG. 1, by placing beneath the rotating mandrel a screen 54 of which the function is to reduce the radiation of the internal surface of the hollow rod once it has left the mandrel. Such a screen constituted by a hollow cylinder of metal with a solid base, can be fixed by screwing at 55 on an extension of the central tube 17.

It is also advantageous to provide a device for secondary cooling by neutral protective gas, whether or not there is a screen 54. As shown in FIG. 1, such a protective gas is distributed via a tube 56 filleted at 57 and screwed into an axial hole 58 made in the bottom 19 of the tube 17. Some radial channels such as 59 place the hole 58 in communication with the exterior. The gas issuing through these holes strikes the solidifying internal wall of the hollow body and therefore accelerates this solidification.

This protective gas is brought to the head 13 at 60. In this way, the cooling water cannot escape from the mandrel 2 and there is no risk of inadvertent penetration of the water into the internal cavity of the solidifying rods. At the top end of the tube 56, a gasket 61 prevents penetration of the cooling water from the tube 17.

A device for lubrication with vegetable oil of the colza oil type can advantageously be provided in the interface between the sleeve 9 and the skin of solidifying metal, for example via a droplet distributor.

The process is carried out in the following manner:

The liquid metal is brought continuously via 3 into the mold 1 which is caused to rotate at constant speed. The internal mandrel 2 is also caused to rotate at a constant speed approximately equal to that of the mould 1 and in the same direction. This rotation of the mandrel is effected either by the mechanism described with reference to FIG. 3 or merely by the friction of the solidifying metal on the internal mandrel, the mechanism described with reference to FIG. 3 only serving to maintain the rotating mandrel in a vertical and centred position in this case. Any local overheating of the mold 1 and of the mandrel 2, in particular by radiation at the point where the liquid metal is introduced via 3 into the mold, is avoided owing to the continuous rotation of the mold 1 and of the mandrel 2. For this reason, the process is highly symmetrical, both thermally and geometrically.

As the cooled wall 4 of the mold 1 makes contact with the sleeve 9 which is also cooled, a solid crust 8 forms and solidification progresses as the hollow rod is extracted from the mold through the bottom.

The free surface of the metal 7 which can optionally be protected by a stream of protective gas supplied in a gaseous or liquid state thus assumes, owing to the rotation of the mold, a general concave shape, as shown in FIG. 1, the external edges being shown at 62. For this reason, the inclusions, dirt or any non-metallic particles floating to the surface of the metal tend to move away from the periphery. This results in a particularly smooth external surface requiring no surface preparation before subsequent transformation. This is well known and described among others in the above-mentioned article from "Revue de Metallurgie-CIT", February 1981 pages 119–136.

On the side of the mandrel 2, the vertical component of the moving magnetic field created by the rotating rotor 18 has the effect of completely modifying the normal solidification conditions in the vicinity of the external surface of the sleeve 9. In fact, the rising stream of liquid metal produced along this sleeve entrains all the dirt and inclusions possibly present rapidly to the free surface of the metal and, moreover, this stream, which is then diverted radially towards the periphery, causes a rise in the level of the liquid metal in the vicinity of the mandrel 2 and the formation of an annular raised area 63 which, by its shape, prevents the dirt floating on the free surface of the metal bath 7 from being deposited on the internal surface of the solidifying hollow body. This mechanical blocking effect is added to the driving effect of the surface stream which keeps the dirt located on the bath remote from the mandrel.

To obtain a raised area of maximum size at 63, the rotation of the metal due to the horizontal component of the moving magnetic field is counteracted by the general movement in the opposite direction of the solidifying hollow rod. The direction of rotation of the hollow rod 8 and, consequently, that of the mold wall 1 driving it and also that of the sleeve 2 should therefore be opposed to the direction of rotation of the rotor 18.

The jet for distributing the liquid metal is orientated in such a way that it allows the rising and convection currents in the vicinity of the mandrel to maintain their maximum effectiveness. To this end, the jet 3 is preferably orientated in such a way that the movement of the metal poured into the mold has a centrifugal radial component, the tangential component which tends to cause the bath to rotate being directed in the direction of rotation of the mold 1. Moreover, the stirring of the solidifying liquid metal in the vicinity of the mandrel has the effect of refining the structure of the internal skin of the hollow body obtained.

This results in a very attractive internal skin for the hollow body which does not require prolonged surface treatment to continue the manufacturing cycle.

The quality of the results obtained by the process according to French Pat. No. 2519567 which has just been described depends mainly on obtaining a sufficiently high speed of rising travel of the liquid metal along the sleeve. It is in fact this rising travel which entrains the dirt and inclusions to the free surface of the metal and which creates an annular raised area round the sleeve which prevents the dirt floating on the surface of the metal bath from being deposited on the internal surface of the solidifying hollow body. It has been seen that, to attain a sufficiently high speed of rising travel, it is generally necessary to cause the magnetic rotor to rotate at an optimum speed which is frequently very close to the critical speed calculated by the formula given above. In many cases, this optimum speed is such that the magnetised layer covering the rotor is likely to be pulled away by the centrifugal force. This risk is so much greater in view of the low permeability of the clearance constituted by the gap between the rotor and the internal wall of the mandrel, the wall of the mandrel and the layer of already solidified metal in contact with the external wall of the mandrel, it is necessary to use a sufficient volume of magnetic material of relatively high density to obtain the desired induction whereas the actual structure of the rotor should remain as light as possible and of minimum volume. In fact, the rotor is housed inside a mandrel of relatively great length which is integral by only one of its ends with a fixing means. It is therefore necessary in numerous cases to limit the speed of rotation of the rotor to a value below the optimum speed which would give the highest speed of rising travel of the liquid metal to avoid pulling away.

Research has therefore been made into the possibility of producing a light magnetic rotor of which the cylindrical wall is covered by at least one spiral made of permanently magnetised material and made integral with the rotor in such a way that the magnetised material is integral with the rotor and can withstand an optimum speed of rotation close to the critical speed without the risk of pulling away. This speed can attain and even exceed 3,000 rpm.

SUMMARY OF THE INVENTION

The device according to the present invention is constituted by a magnetic rotor for the continuous casting of hollow bodies allowing a moving magnetic field to be established which traverses the wall of a mandrel inside which is housed the rotor and which acts on the liquid metal surrounding the mandrel creating forces which move this liquid metal. This rotor is caused to rotate about its axis by a drive means. Its structure comprises a rotating part produced from a magnetic material round which there is arranged following at least one spiral a magnetised magnetic material which is made integral with the rotor by at least one collar constituted by a material based on natural or synthetic fibres having high mechanical characteristics, such as a high modulus of elasticity this collar covering the magnetised magnetic material and surrounding the rotor. The connection between the collar and the substrate is preferably produced by a polymerised synthethic resin which impregnates the collar. The magnetic material constituting the rotor is preferably a mild steel or a carbon steel such as a structural steel.

The number of co-axial spirals made of magnetised magnetic material is preferably an even number. The gaps between the successive turns of the spiral or spirals made of magnetised magnetic material are preferably filled with a filler which is, for example, a mixture of fibrous substance and synthetic resin such as a polymerisable mastic reinforced by glass fibre. A felt of non woven fibrous material is preferably arranged between the collar and the magnetised magnetic material. Fibres having high mechanical characteristics such as glass fibres or polyamide fibres are preferably used for forming the collar. The connection between the felt, the hoop and the substrate is preferably provided by a polymerised synthetic resin which impregnates both the collar and the felt.

According to a particularly advantageous solution, the magnetic rotor comprises two co-axial magnetic spirals of which the adjacent turns have parallel directions of magnetisation of opposing direction. A magnetic rubber, for example in the form of a tape or a cobalt-based alloy containing at least one rare earth metal such as, for example, samarium can be used as magnetised magnetic material.

The invention also relates to a process for manufacturing metallic hollow bodies by vertical continous casting in which a liquid metal is introduced continuously into an annular space between an external metal mold cooled by circulation of fluid and in which the liquid metal is subjected in an annular zone close to the external surface of the mandrel, to the action of a moving magnetic field created by the magnetic rotor according to the invention.

DESCRIPTION OF THE PREFERRED EMBODIMENTS

Numerous embodiments of the device and of the process forming the subject of the invention can be considered.

The following examples describe the invention in a non-limiting manner.

EXAMPLE 1

Figure 5:
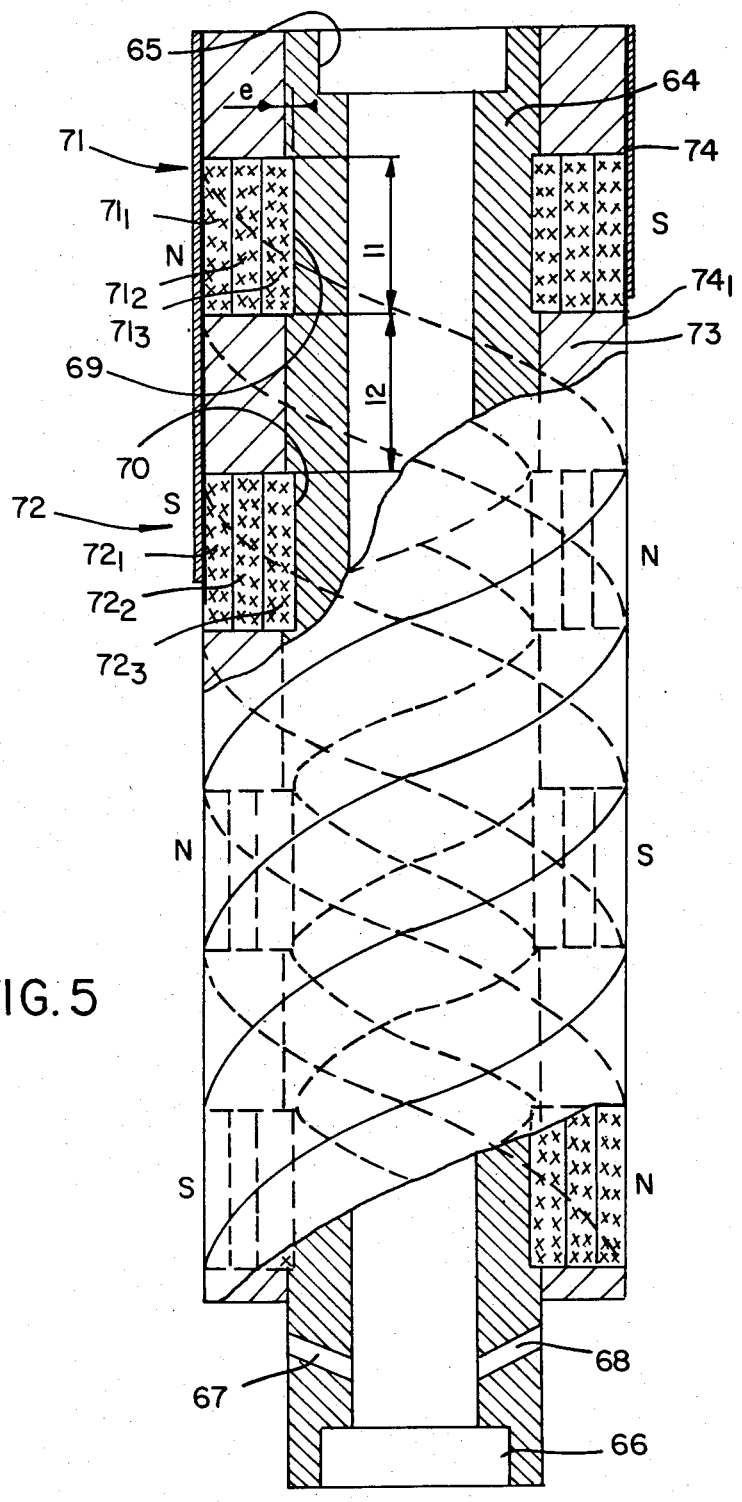
FIG. 5 is a magnetic rotor according to a first embodiment of the present invention in a partial axial section at the top of the Figure comprising two spirals of magnetic rubber.

FIG. 5 shows a first embodiment of a magnetic rotor for the continuous casting of metallic hollow bodies according to the present invention. This rotor comprises a rotating part made of magnetic metal constituted by a cylinder 64 of carbon steel, such as a X C 35 type steel (AFNOR standard). This cylinder has at each of its two ends a housing 65–66 intended to receive a friction ring or a ballbearing enabling it to rotate at high speed about its axis with the minimum of friction. A turbine machined in the lower portion of the rotor comprises openings which are illustrated schematically at 67–68 and are orientated and dimensioned in such a way that the fluid traversing them, as described above, causes rotation of the rotor at the desired speed. Two parallel helical grooves 69–70 are machined on the surface of this cylinder. These grooves have a relatively shallow depth (e) and a great length ($1_1$). The distance ($1_2$) between two successive grooves is preferably close to ($1_1$). The magnetic material is engaged in part in these grooves. A magnetic rubber tape, for example, is used, of which the active substance is usually a ferrite which is stuck by a suitable means in the groove. To obtain a sufficient volume of magnetic material, several thicknesses of magnetic rubber are preferably stuck. In the case shown in FIG. 5, two magnetic spirals 71–72 each constituted by three layers of magnetic rubber $71_1$-$71_2$-$71_3$ and $72_1$-$72_2$-$72_3$ are produced. Within each spiral, the axis of north-south magnetisation is radial and of the same direction right along the spiral. On the other hand, the direction of magnetisation changes from one spiral to the other. Thus, in the case shown in FIG. 5, the spiral 71 has a north pole (N) on the exterior and the spiral 72, on the other hand, a south pole (S).

In order effectively to make the magnetic spirals integral with each other and with the steel cylinder, the gap 73 between the spirals is filled with a filling and binding material such as a mixture of fibrous material and a polymerisable resin having a good wetting capacity relative to the surface of the steel cylinder and also relative to the magnetic substance. The adhesion can be improved by milling the surface of the cylinder. Once the resin has hardened, this binding substance prevents, in particular, any movement of the magnetic spirals relative to each other.

The magnetic material and the filler are hooped on the carbon steel cylinder by means of a collar 74 comprising a fibre-based fabric having a high modulus of elasticity which completely covers the cylindrical surface formed by the two magnetic spirals and the filler. This collar 74 is shown in a partial section in FIG. 5 at its top.

To improve the bonding between the fabric of the collar 74 and the sub-jacent materials a thin layer, ($74_1$)

shown in FIG. 5, of a glass fibre based non woven felt is placed between the two, the assembly then being impregnated with a liquid synthetic resin which, after polymerisation, provides an excellent bond between the hoop, the felt and the substrate, that is to say the steel cylinder surrounded by the magnetic spirals and the filler.

The thickness of the collar is calculated so as to keep the magnetic spirals flat against the cylinder in spite of the centrifugal force exerted on the magnetic material when the rotor turns at its rated speed. Fibres with high mechanical characteristics for the production of the collar include, in particular, glass fibres, polyamide fibres or again carbon or boron fibres. Fibres having a high modulus of elasticity are preferably used. Certain natural fibres may also be suitable.

The relative dimensions of the various elements constituting the magnetic rotor are selected by the skilled man as a function of the various parameters of the installation for the continuous casting of hollow bodies to be produced and can vary within quite wide limits. It is also possible to use, for the continuous casting of steel hollow bodies, a copper internal mandrel in which there is housed a magnetic rotor having an external diameter of 144 mm and a height of 600 mm. This rotor is caused to rotate about its axis at a speed of the order of 3,000 rpm by a turbine in the manner described above. This rotor comprises a cylindrical core made of structural steel having a diameter of 87 mm and a height of 600 mm.

Two parallel spiral grooves having a cylindrical base with a depth of 1.5 mm and a width of 50 mm are machined on this core. Each of these spiral grooves is machined round the cylinder at a pitch of 200 mm so that the distance between the closest edges of two grooves is 50 mm. Three superimposed layers of a magnetic rubber tape having a thickness of approximately 9 mm and a width corresponding to that of the groove are placed in each of the grooves. These tapes are stuck in the bottom of the groove and also stuck to each other. The gap between the turns is filled with a glass fibre reinforced polymerisable mastic. The assembly is then enveloped in a layer having a thickness of approximately 1 mm of a glass felt which is in turn covered by a fabric constituted by polyamide fibres having a high mechanical strength and a high modulus of elasticity and a thickness of approximately 2 mm. The collar and the felt are impregnated with a polymerisable liquid resin which, after hardening, provides the bond between the collar, the felt and the substrate. The thickness of the collar and that of the felt are adjusted so that the external diameter of the magnetic rotor reaches approximately 144 mm. Due to this collar, the magnetic tape forms a block with the core of the rotor and withstands, without moving, the centrifugal stresses resulting from the rotation at 3,000 rpm of the magnetic rotor.

The clearance between the external surface of the rotor and the internal surface of the mandrel in which it is housed should be as small as possible, while allowing sufficient passage for the circulation of coolant, usually water. In the case of the present example, the flow rate of this fluid should be determined, taking into consideration not only the calories to be drained but also the need to drive the turbine at the desired speed. As mentioned above, the distance between the polar surfaces of the magnetic spirals and the facing surface of the liquid metal should be limited to the minimum. This distance or clearance corresponds to the sum of three terms: the thickness of the solidified metal in contact with the external surface of the mandrel wall, the thickness of this mandrel wall and the distance between the internal surface of this mandrel wall and the external surface of the magnetic spirals. Each of these terms should therefore be optimised by applying knowledge familiar to the man skilled in the art of material strength, thermal energy and hydrodynamics.

EXAMPLE 2

This example relates to a second method of carrying out the present invention in which a magnetic field which is much more intense than the one obtained using magnetised rubber is used. For this purpose, magnets based on rare earth cobalt such as the CORAMAG magnets (trade mark filed by AIMANTS UGIMAG S.A.), for example. These magnets enable the magnetic field produced to be multiplied by a factor of 4, with equal volume, owing to their very large coercive field of induction of approximately 8,000 Oe and to their very great residual induction of the order of 8,300 G. This means that the use of these magnets permits very significant gains in weight and inertia to be achieved owing to the very great specific energy of approximately 17 MG.Oe.

Figure 6:
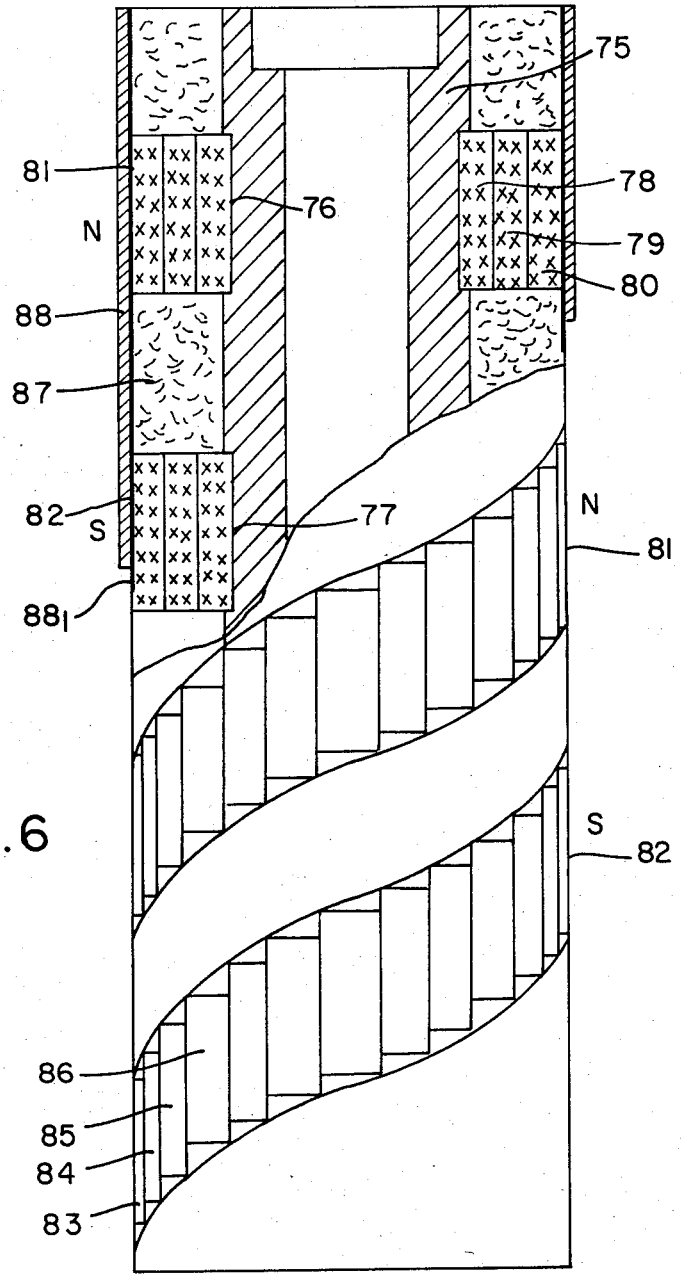
FIG. 6 is a magnetic rotor according to a second embodiment of the present invention in a partial axial section at the top of the Figure comprising two spirals of cobalt rare earth magnetic alloy.

FIG. 6 shows a magnetic rotor comprising such magnets in a partial section.

The general arrangement is similar to the one described with reference to FIG. 5. A rotor constituted by a carbon steel cylinder 75 of the same design as the cylinder 64 in FIG. 5 is used in this case. The lower portion of the cylinder comprising the drive turbine similar to the one described schematically in FIG. 5 is not shown.

This rotor, like the one in FIG. 5, comprises two parallel helical grooves 76 and 77 of shallow depth and of relatively large width in which there are housed some parallelepiped plates made of rare earth cobalt magnetic alloy such as those marketed under the trade mark CORAMAG. These alloys are based on cobalt and contain rare earths such as samarium combined with the cobalt at least in part in the form of intermetallic compounds such as TR $Co_5$ or $TR_2Co_{17}$, TR being a rare earth metal.

In the case of a diameter at the bottom of the groove, for example, of approximately 80 mm, parallelepiped plates of $18 \times 19 \times 10$ mm magnetised in the direction of the smallest thickness (10 mm in the present case) are used. In order to obtain a maximum effect, three layers of plates such as 78, 79 and 80 are superimposed, the greatest dimension of the plates being parallel to the generatrices of the cylinder and the shortest, corresponding to the axis of magnetisation, being orientated radially. Similarly in the case of the preceding example, the direction of magnetisation is the same within the same spiral and alters from one spiral to another.

In the case shown in FIG. 6, the spiral 81 comprises plates whose north pole (N) is located on the side most remote from the rotor axis whereas, with the spiral 82, the south pole (S) on the other hand is most remote from the rotor axis. The side by side spiral arrangement of the magnetised plates (such as 83, 84, 85, 86) on the periphery of the rotor is seen most clearly in the lower half of FIG. 6. These plates are preferably stuck on the rotor one on top of the other by means of a synthetic adhesive. However, in view of the high density of these magnetic alloys (of the order of 8.4) the risks of pulling away are very great and it is necessary, according to one of the essential means of the invention, forcefully to grip these magnetised plates on the rotor by means of a collar comprising fibres of high mechanical strength. As in the previous example, a filling and bonding substance 87 such as a polymerisable mastic reinforced with glass fibre which fills the gap between the turns is used and a collar 88 constituted by a layer of fabric based on fibres having high mechanical characteristics and, in particular, a high modulus of elasticity is then placed round the assembly and completely covers the cylinder. This collar can be constituted, for example, by a tape wound spirally round the cylinder or can have the shape of a sleeve which is slipped round the cylinder. A glass-fibre based fabric, for example, can be used for this purpose.

In FIG. 6, the collar 88 is shown only in part in the zone in an axial section. It obviously covers the entire cylindrical surface of the rotor so as to grip strongly the magnetised plates and to hold them firmly in contact with the bottom of the grooves 76 and 77 even if the rotor is rotated at 3,000 rpm or faster. The collar 88 is preferably made integral with the substrate by impregnating this collar with a polymerisable liquid resin of a known type.

To improve the bond between the collar and the subjacent materials, a non-woven felt ($88_1$), for example, a glass fiber based felt, is placed between the two and produces elastic gripping at all points. The bond between the collar, the felt and the subjacent materials is preferably produced by impregnation with polymerisable liquid resin.

Numerous embodiments of the magnetic rotor according to the invention can be considered. In particular, various magnetic metals or alloys can be used, as for the rotor. It is generally preferable to use mild steels or carbon steels such as common types of structural steel. Numerous types of magnet of which the magnetic or dimensional characteristics can be extremely varied can be used as magnetised magnetic material.

It is possible to provide, not two magnetic spirals of opposed polarity, but a single spiral of single polarity. The variation in the field in the liquid metal is thus at least twice as weak and the effectiveness reduced. It is also possible to provide more than two co-axial spirals by alternating the polarity between adjacent turns. Such a solution may be of interest with large diameter rotors. An even number of spirals is preferably used in this case.

Similarly, the magnetic rotor can be caused to rotate by numerous different means. In particular, this drive can be produced not by means of a turbine driven by the coolant but by means of an electric motor which can drive the rotor in a direct manner, for example by rotating field or can be connected thereto by a mechanical drive means of suitable length. Finally, the collar can also be produced in a large number of different ways by making use of a wide variety of synthetic or even natural fibres. None of these variations departs from the scope of the invention.

We claim:

1. A magnetic rotor for the continuous casting of hollow bodies, said rotor permitting a moving magnetic field to be produced which traverses the wall of a mandrel inside which the rotor is housed, and wherein said field acts on the liquid metal surrounding the mandrel, creating forces which move this liquid metal, the improvement including a drive means for rotating the rotor about its axis, said rotor comprising a rotatable cylinder formed of a magnetic material, a magnetised magnetic material arranged in at least one spiral around said rotatable cylinder, and including a collar formed of a material containing natural or synethetic fibers, said collar covering the magnetised magnetic material whereby said magnetised magnetic material is made integral with the underlying rotatable cylinder.

2. A magnetic rotor according to claim 1, wherein the collar is impregnated with a polymerised synthetic resin which provides a bond between the collar and the magnetised magnetic material.

3. A magnetic rotor according to claim 17 wherein the magnetic material is a metal or alloy such as a mild steel or a carbon steel.

4. A magnetic rotor according to claim 1 wherein the material constituting the collar is a fiber-based fabric containing fibers selected from the group comprising glass, polyamide, carbon and boron fibers.

5. A magnetic rotor according to claim 1 wherein said rotor comprises two co-axial magnetic spirals of which the adjacent turns have parallel directions of magnetisation of opposing direction.

6. A magnetic rotor according to claim 1 wherein said rotor comprises an even number of spirals greater than 2.

7. A magnetic rotor according to claim 1 wherein gaps formed between successive turns of the spiral or the spirals of magnetised magnetic material are filled with a filler.

8. A magnetic rotor according to claim 7, wherein the filler is a mixture of fibrous material and of polymerisable synthetic resin.

9. A magnetic rotor according to claim 7, wherein the filler is a polymerisable mastic reinforced with glass fiber.

10. A magnetic rotor according to claim 1 wherein a felt of non woven fibrous material is arranged between the collar and the magnetised magnetic material.

11. A magnetic rotor according to claim 10, wherein the felt and the collar are impregnated with a polymerisable liquid resin to provide a bond between the felt, the collar and the magnetised magnetic material.

12. A magnetic rotor according to claim 1 wherein the magnetised magnetic material is a magnetic rubber.

13. A magnetic rotor according to claim 12, wherein the magnetic rubber is in the form of tape.

14. A magnetic rotor according to claim 1 wherein the magnetised magnetic material is a cobalt based alloy containing at least one rare earth metal.

15. A magnetic rotor according to claim 14, wherein the magnetised magnetic material contains samarium.

* * * * *

UNITED STATES PATENT OFFICE

CERTIFICATE OF CORRECTION

Patent No. 4,614,225 Dated September 30, 1986

Inventor(s) Ernst et al.

It is certified that error appears in the above-identified patent and that said Letters Patent are hereby corrected as shown below:

Column 12, line 20 "17" should be -- 1 --.

Signed and Sealed this

Twenty-third Day of December, 1986

*Attest:*

DONALD J. QUIGG

*Attesting Officer* *Commissioner of Patents and Trademarks*